US005634829A

United States Patent [19]

Kerul

[11] Patent Number: 5,634,829

[45] Date of Patent: Jun. 3, 1997

[54] LOW ENGAGEMENT FORCE TERMINAL WITH EASY OFF-AXIS DISENGAGEMENT

[75] Inventor: Joseph A. Kerul, Canton, Mich.

[73] Assignee: Interlock Corporation, Westland, Mich.

[21] Appl. No.: 425,928

[22] Filed: Apr. 20, 1995

[51] Int. Cl.[6] ..... H01R 11/22

[52] U.S. Cl. ..... 439/851; 439/842

[58] Field of Search ..... 439/842, 843, 439/851–857, 861, 862, 849, 850

[56] References Cited

U.S. PATENT DOCUMENTS 4,002,400 1/1977 Evans ..... 439/851

4,666,227 5/1987 Galazia et al. ..... 439/851

5,462,459 10/1995 Childs ..... 439/843

*Primary Examiner*—David L. Pirlot

*Attorney, Agent, or Firm*—Harness, Dickey & Pierce, P.L.C.

[57] ABSTRACT

A low insertion force electrical contact terminal assembly in which the female terminal has multiple cantilevered arms which engage and retain the male terminal therein. The multiple cantilevered arms resist withdrawal of the male terminal along the mating axis but will readily permit withdrawal during an off-axis disengagement of the terminals.

20 Claims, 1 Drawing Sheet

LOW ENGAGEMENT FORCE TERMINAL WITH EASY OFF-AXIS DISENGAGEMENT

BACKGROUND AND SUMMARY OF THE INVENTION

This invention generally relates to a low insertion force electrical terminal assembly and, more particularly, to a terminal assembly having mated male and female members which are generally easy, in terms of the amount of required force, to engage while still providing a high contact normal force when engaged. Additionally, the present invention resists permanent deformation of the terminals as a result of repeated engagement and disengagement while still providing for easy "off-axis" disengagement of the terminals, Terminal assemblies are used in a wide variety of products having electrical components. These products range from simple electrical items, such as a lamp, to those with highly sophisticated electrical systems, such as an automobile. One variety of terminal assembly uses a generally cylindrical male member and a female member which are mated together along a mating axis. Typically, the terminals are formed by bending a stamped piece of conductive material into the desired configuration. When formed by bending, common terminal materials include nickel plated tin, stainless steel and beryllium copper, While mated terminals generally work well for their intended purposes, a number of problems can arise when the terminals are repeatedly engaged and disengaged from one other. One problem is that the terminals may become deformed as a result of this repeated engagement and disengagement. Deformation is particularly a problem when the rigid male terminal is repeatedly inserted and withdrawn from a female terminal, having a deflectable contact element within a rigid housing, either along or at an angle with respect to the mating axis. Repeated insertion and withdrawal can also result in a decreased contact normal force, a loss in electrical interface integrity, material fatigue, as well as a decrease from the designated amount of force required for disengagement of the terminals. This latter problem allows the terminal assembly to be more susceptible to inadvertent disengagement.

To maintain the proper resistance to disengagement, one solution is to create a "tighter fit" between the terminals. Another is to use less resilient materials in forming the terminals. However, both of these solutions result in an increase in the force needed to insert the male terminal into the female terminal. Unfortunately, the requirement of a high insertion force is undesirable from a product assembly standpoint.

With the above limitations in mind, it is an object of the present invention to provide a terminal assembly which can be easily engaged along a mating axis and disengaged off-axis.

Still another object of this invention is to provide a terminal assembly that maintains a high contact normal force between the terminals even after repeated engagement and disengagement of the terminals. A related object is therefore sustaining the electrical interface integrity between the terminals after repeated engagement and disengagement.

A further object of this invention is to provide a terminal assembly which exhibits a greater resistance to disengagement when being pulled apart along the mating axis than when off-axis.

In achieving these an other objects, the present invention provides a terminal assembly which has male and female terminals that are adapted for mated engagement along a mating axis. The male terminal is inserted into a female terminal having cantilevered arms. A first ramped surface of the arms is inclined toward the mating axis, proceeding from the lead end of the female terminal toward a connector end which is adapted to engage a conductive wire or other means and which defines the point at which the arms are cantilevered. The first ramped surface is defined on the arms of the female member a predetermined distance from the connector end and at a predetermined angle with respect to the mating axis.

A second ramped surface, adjacent to the first, is formed on the female member so as to define another ramp angle with respect to the mating axis. This second ramped surface, however, is inclined in a direction away from the mating axis proceeding from the lead end toward the connector end. The ramp angle of the second ramped surface is less than that of the first.

A third ramped surface is also included on the female terminal. This surface is inclined toward the mating axis proceeding from the lead end and is also angled with respect to the mating axis in an amount greater than the second ramped surface.

In the preferred embodiment, the female terminal is longitudinally divided in thirds so that the first, second and third ramped surfaces are all formed on three resilient arms. The arms operate as a means for biasing the ramped surfaces inward into contact with the male terminal. The lead ends of the arms are, therefore, freely movable while at the opposite ends they are substantially rigid and connected to one another. Accordingly, when fully engaged with the male terminal, the arms will have snapped over the male terminal and will not be in a maximum deflected condition. They will, however, be in slightly deflected condition as further discussed below.

To require different insertion and withdrawal forces, the ramp angles of the ramped surfaces can be changed as well as the distance of these surfaces along the cantilevered arm and from the fixed end of the terminal.

When the male and female terminals are being engaged with each other, the first ramped surface contacts a correspondingly angled surface on the male terminal. The inherent biasing and length of the resilient arms cooperate with the first ramp angle to provide a decreased amount of resistance during insertion of the male member. After being inserted to a certain extent, the arms of the female terminal snap over the male terminal and the second and third ramped surfaces generally circumferentially engage corresponding surfaces on the male terminal in a condition with reduced deflection.

Being a shorter distance from the connector end, the force required to bias the arms and surfaces at these locations is greater and a high contact normal force is maintained between the terminals. When the male terminal is to be withdrawn from the female terminal, if an attempt is made to withdraw the male terminal along the mating axis, an increased amount of resistance is met because of the shorter relative length of the arms with respect to the back angle of the second ramped surface and the corresponding surface of the male terminal. If, on the other hand, the male terminal is withdrawn off-axis (with respect to the mating axis) less resistance is encountered because of the change in relation of the relevant surfaces in both the female and male terminals, as well as the use of the male connector itself as a lever arm to defect at least one of the arms of the female terminal.

Additional benefits and advantages of the present invention will become apparent to those skilled in the art to which this invention relates from the subsequent description of the preferred embodiments and the appended claims taken in conjunction with the accompanying drawings.

DETAILED DESCRIPTION OF THE PREFERRED EMBODIMENT

Figure 1:
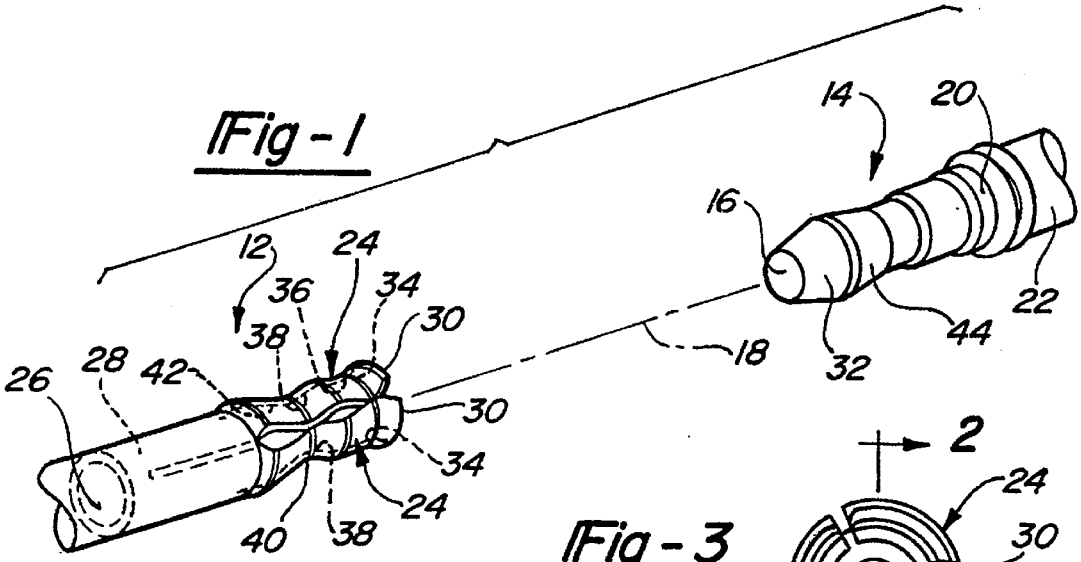
FIG. 1 is a perspective view of a male and female terminal assembly incorporating the principles of the present invention.
Figure 3:
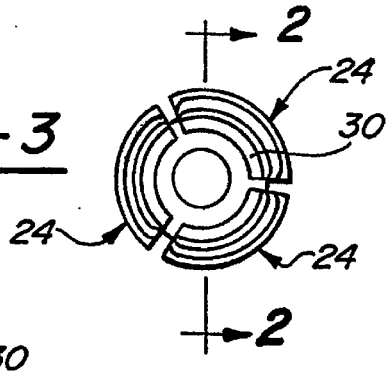
FIG.3 is an end view of the female terminal seen in FIG. 1.

Referring now to FIG. 1, an electrical contact terminal embodying the principles of the present invention is generally illustrated therein and designated at 10. The terminal assembly 10 includes a female terminal 12 and a male terminal 14.

The male terminal 14 is constructed of a stamped piece of conductive material which is folded into the shown configuration so that it has a substantially rigid form which generally conforms in shape to the interior of the female terminal 12. As further described below, the male terminal 14 includes a lead end 16 which is introduced along the mating axis 18 into the female terminal 12. At the opposite end of the male terminal 14 is a connector end 20 adapted for securement to a electrical conductor 22.

Figure 2:
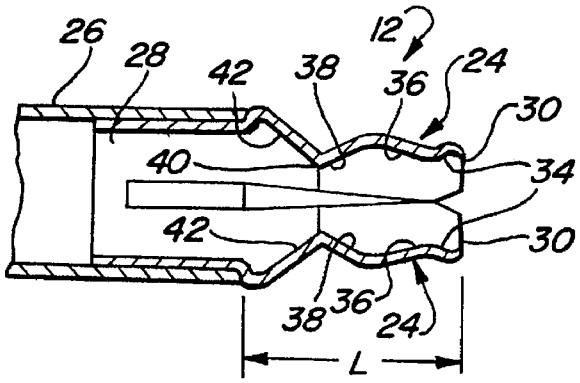
FIG. 2 is a longitudinal sectional view through the female terminal shown in FIG. 1.
Figure 4:
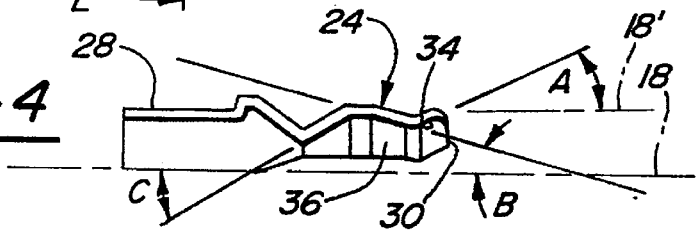
FIG. 4 is a partial sectional view illustrating the angularity of the various surfaces of the terminal in relation to the mating axis.

The heart of the invention lays in the construction of the female terminal 12. As seen in FIGS. 1 and 2, the female terminal 12 is also formed from a stamped conductive material which is configured into the illustrated shape. A principle features of the female terminal 12 is its three cantilevered arms 24 which are equidistantly spaced about the mating axis 18. Accordingly, the arms are 120 ° apart. Alternatively, more or less than two arms 24 could be utilized without deviating from the intended scope of the present invention. The relative length of the cantilevered arms 24 is limited by a sleeve ferrule 26 mounted over a connector end 28 of the female terminal. Accordingly, the effective length of the cantilevered arm extends from the end of the ferrule 26 to a lead end or lip 30 on each arm 24. This length is designated as L in FIG. 2. Also as seen in FIGS. 1 and 2, each arm 24 is slightly predisposed or biased toward the mating axis 18 in its normal or unengaged condition. When engaged with the male terminal 14, this predisposed positive bias of the arms 24 cooperates to resist permanent deformation of the arms 24 and also provide a high contact normal force which establishes the integrity of the electrical contact between the male terminal 14 and the female terminal 12 when fully engaged.

Upon insertion of the male terminal 14 into the female terminal 12, the lead end 16 of the male terminal 14 is introduced into the receptacle opening defined by the lips 30 of the arms 24. After being inserted a certain distance, a lead surface 32 on the male terminal 14 will engage a first ramped surface on each arm 24 of the female terminal 12. The first ramped surface 34 exhibits an angle with respect to the mating axis 18 which is within the range of 20°–35° as generally designated at A with respect to the reference mating axis 18'. More preferably, the first ramped surface 34 is angled at approximately 28° with respect to the mating axis 18. Proceeding from the lip 30 toward the connector end 28, it can be seen that the first ramped surface 34 is inclined in a direction toward the mating axis 18. The angle of this incline in combination with the length of the arm 24 out to the first ramped surface 34, allows the insertion of the male terminal 14 to deflect their arms 24 radially outward permitting entry of the male terminal 24 into the female terminal 12 relatively easily. In other words, the amount of force required to insert the male terminal 14 into the female terminal is low in comparison to the force required to withdraw it.

The first ramped surface 34 merges into a second ramped surface 36 along the interior of the female terminal 12. The second ramped surface 36 is inclined away from the mating axis 18 when proceeding from the lip 30 towards the connector end 28 of the female terminal 12. Preferably, the inclination of the second ramped surface relative to the mating axis is less than the angularity A of the first ramped surface 34. The angularity of the second ramped surface 36 is generally designated at B.

Proceeding further towards the connector end 28 of the female terminal 12, the second ramped surface 36 merges into a third ramped surface designated at 38. The third ramped surface 38 has an angularity C with respect to the mating axis 18 preferably within the range of 25°–35°. More preferably, this angularity C is approximately 30°. As seen in FIG. 2, proceeding from the lip 30 towards the connector end 28 of the female terminal, the third ramped surface 38 is declined with respect to the mating axis 18 and terminates at a restriction generally designated at 40 before forming an outward flare 42 which merges with the connector end 28.

During insertion of the male terminal 14, after the lead surface 32 of the male terminal has passed beyond the first ramped surface, a trailing surface 44 on the male terminal contacts the second ramped surface 36 of the female terminal as the arms 24 snap over and clamp onto the male terminal 14. When fully inserted, the lead end trailing surfaces 32 and 44 of the male terminal will be engaged by the second and third ramped surfaces 36 and 38 of the female terminal 12. Further insertion of the male terminal 14 is prohibited by the restriction 40 and the relatively short cantilevered distance of the arms 24 at that point. Accordingly, it is increasingly harder to further insert the male terminal 14 into the female terminal 12.

Figure 5:
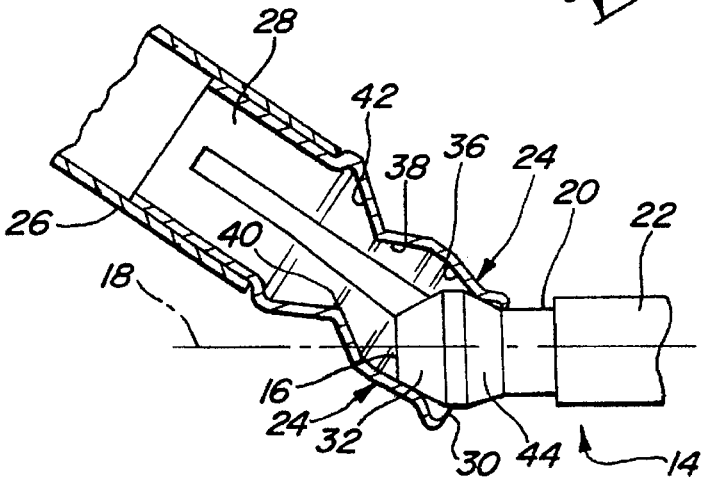
FIG. 5 is a partial sectional view illustrating the disengaging of the female terminal from the male terminal at an off-axis orientation.

Withdrawal of the male terminal is relatively difficult if attempted substantially along the mating axis 18. This is because of the relatively short cantilevered distance of the arms 24 at the point where the second ramped surface 36 will be engaging the following surface 44 of the male terminal 14. More easy disengagement can be achieved by withdrawing the male terminal 14 off-axis as seen in FIG. 5. In so doing, the male connector 14 is used as a lever arm and causes one or more of the cantilevered arms 24 to cam off of the trailing surface 44 and another arm 24 to deflect. Once this deflection is achieved, the trailing surface 44 can easily slide out of engagement with the second ramped surface 36 of the deflected arm accomplishing withdrawal. Alternatively, the male connector 14 can be pivoted while in the female terminal 12 causing the deflection mentioned above with respect to off-axis withdrawal, and further pivoting will cause the male terminal to roll out of engagement with the female terminal 12. Both off-axis movements of the male terminal 14 are aided by the three armed 24 configuration of the female terminal 12. The multiple arms 24 allow for substantially any off-axis withdrawal to be readily accomplished.

While the above description constitutes the preferred embodiments of the present invention, it will appreciated that the invention is susceptible to modification, variation and change without departing from the proper scope and fair meaning of the accompanying claims.

I claim:

1. A low insertion force electrical contact terminal assembly comprising a male terminal and a female terminal, said female terminal constructed of metal and having at least two cantilevered biased arms equidistantly spaced about a central longitudinal axis, said arms being interconnected at a first end adapted for securement to an electrical conductor means, each of said arms also being independently and freely movable at a second end opposite said first end, said second end terminating in a lip cooperating to define an insertion opening in said female terminal and through which a correspondingly shaped male contact terminal is adapted to be received and engaged with interior surfaces of each of said arms upon a relatively low insertion force, each of said arms including first, second and third ramped surfaces, said first ramped surface being adjacent to said lip and angled inward toward said central axis when viewed proceeding away from said lip and toward said first end, said second ramped surface being generally adjacent to said first ramped surface and being angled outward away from said central axis when viewed proceeding from said lip and toward said first end, said third ramped surface being generally adjacent to said second ramped surface and being angled inward toward said central axis when viewed proceeding from said lip and toward said first end, said first and third ramped surfaces being angled with respect to said central axis in an amount greater than said second ramped surface, said third ramped surfaces of said arms cooperating to define a reduced diameter portion which acts to limit the distance which said male contact terminal can be inserted into said female contact terminal, the cantilevering of said arms further cooperating such that said second and third ramped surfaces provide a substantially circumferential high contact normal force against said male contact terminal thereby substantially eliminating relative movement between said female and male contact terminals and microarcing result from relative movement, the decreased angle of said second ramped surfaces cooperating with the independent deflectability of said arms to provide a decreased resistance to withdrawal of said male contact terminal from said female terminal when withdrawal is at an off-angle relative to said central axis, said male terminal including portions configured to engage said first, second and third ramped surfaces of said female terminal.

2. A terminal as set forth in claim 1 wherein said arms are curved in transverse cross section defining a generally circular insertion opening.

3. A terminal as set forth in claim 1 wherein said arms are generally angled inward toward said central axis when in a non-engaged condition with said male contact terminal.

4. A terminal as set forth in claim 1 wherein said arms are generally angled outward away from said central axis when in an engaged condition with said male contact terminal.

5. A terminal as set forth in claim 1 wherein said first ramped surface smoothly merges into said second angled surface.

6. A terminal as set forth in claim 1 wherein said first ramped surface is angled with respect to said central axis at an angle within the range of 20°–35°.

7. A terminal as set forth in claim 1 wherein said first ramped surface is angled with respect to said central axis at an angle of about 28°–29°.

8. A terminal as set forth in claim 1 wherein said third ramped surface is angled with respect to said central axis at an angle within the range of 25°–35°.

9. A terminal as set forth in claim 1 wherein said third ramped surface is angled with respect to said central axis at an angle of about 30°.

10. A terminal as set forth in claim 1 wherein said female terminal includes three cantileverly biased arms.

11. A terminal as set forth in claim 10 wherein said arms are equidistantly spaced about said central axis at approximately 120° intervals.

12. A terminal as set forth in claim 1 wherein said second ramped surface smoothly merges into said third angled surface.

13. A terminal as set forth in claim 12 wherein first ramped surface smoothly merges into said second angle surface.

14. A terminal as set forth in claim 1 wherein said arms having a length which is greater than the maximum width of said female terminal as defined by said arms.

15. A terminal as set forth in claim 14 wherein said length is less than twice the maximum width of said arms.

16. A terminal as set forth in claim 14 wherein said length is approximately 1.5 times the maximum width of said arms.

17. A terminal as set forth in claim 14 wherein said length is less than 1.5 times the maximum width of said arms.

18. A low insertion force electrical contact terminal comprising a female terminal constructed of metal and having at least two cantilevered biased arms equidistantly spaced about a central longitudinal axis, said arms being interconnected at a first end adapted for securement to an electrical conductor means, each of said arms also being independently and freely movable at a second end opposite said first end, said second end terminating in a lip cooperating to define an insertion opening in said female terminal and through which a correspondingly shaped male contact terminal is adapted to be received and engaged with interior surfaces of each of said arms upon a relatively low insertion force, each of said arms including first, second and third ramped surfaces, said first ramped surface being adjacent to said lip and angled inward toward said central axis when viewed proceeding away from said lip and toward said first end, said second ramped surface being generally adjacent to said first ramped surface and being angled outward away from said central axis when viewed proceeding from said lip and toward said first end, said third ramped surface being generally adjacent to said second ramped surface and being angled inward toward said central axis when viewed proceeding from said lip and toward said first end, fourth ramped surface being located between said first end and said third ramped surface and being angled away from said central axis proceeding toward said first end, said first and third ramped surfaces being angled with respect to said central axis in an amount greater than said second ramped surface, said third ramped surfaces of said arms cooperating to define a reduced diameter portion which acts to limit the distance which said male contact terminal can be inserted into said female contact terminal, the cantilevering of said arms further cooperating such that said second and third ramped surfaces provide a substantially circumferential high contact normal force against said male contact terminal thereby substantially eliminating relative movement between said female and male contact terminals and microarcing resulting from relative movement, the decreased angle of said second ramped surfaces cooperating with the independent deflectability of said arms to provide a decreased resistance to withdrawal of said male contact terminal from said female terminal when withdrawal is at an off-angle relative to said central axis.

19. A terminal as set forth in claim 18 wherein said fourth ramped surface is angled with respect to said central axis at an angle within the range of 25°–40°.

20. A terminal as set forth in claim 18 wherein said fourth ramped surface is angled with respect to said central axis at an angle of about 33°–34°.

* * * * *

UNITED STATES PATENT AND TRADEMARK OFFICE

CERTIFICATE OF CORRECTION

PATENT NO. : 5,634,829

DATED : June 3, 1997

INVENTOR(S) : Joseph A. Kerul

It is certified that error appears in the above-indentified patent and that said Letters Patent is hereby corrected as shown below:

In column 3, line 44, "features" should be --feature--.

In column 4, line 13, "24" should be --14--.

In column 5, Claim 1, line 44, "result" should be --resulting--.

Signed and Sealed this

Twenty-seventh Day of January, 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,634,829

DATED : June 3, 1997

INVENTOR(S) : Joseph A. Kerul

It is certified that error appears in the above-identified patent and that said Letters Patent is hereby corrected as shown below:

On the Title Page, Item [73] Assignee: "Interlock Corporation" should read —Framatome Connectors USA, Inc.—

Signed and Sealed this

Thirty-first Day of March, 1998

Bruce Lehman

*Attest:*

BRUCE LEHMAN

*Attesting Officer*

*Commissioner of Patents and Trademarks*